of the same size as a corresponding aperture 30 in the bottom member 26. The transfer pipes 31 are thus fit slidingly in these apertures also. Each wing 35 extends into a corresponding radially inwardly extending slot 36 in the bottom member 26. The plate 34 is thereby restrained against rotation, but is able to slide up and down with respect to the member 26.

Upstanding from the perimeter of plate 34, and attached thereto, is a short tubular distribution member 37. The member 37 has an inner sleeve 38 affixed thereto, the member 37 being shaped such that the sleeve, when fitted, defines an annular rectangular section passageway 39. Extending radially inwardly from the sleeve 38 are eight evenly spaced lengths 40 of pipe which each communicate with the passageway 39, as shown most clearly in FIG. 5. The opposite end of each length 33 of flexible tube is fitted over a respective length 40 of pipe.

The plate 34 has an outwardly extending tangential protrusion 41 which is tapered at its end 42. The distribution member 37 is similarly provided with a shorter tangential protrusion 43. The protrusion 43 carries an air passageway from the passageway 39 to an orifice 44 at the outer surface of the protrusion 43. When the magazine unit is swung into position about the post 12, the protrusions 41 and 43 enter a rectangular cutout 45 in the housing 1 for reasons which will be explained hereinafter.

The protrusions 41 and 43 are movable in a vertical direction within cut-out 45 by means (not shown in FIGS. 1 to 8) within housing 1. During this movement the protrusions remain horizontal and carry with them the distribution member 37 and support plate 34. The position shown in FIGS. 4 and 5A is the uppermost position of the plate 34. As the plate is moved downwards, the transfer pipes 31 also move downwards until the bottom of the transfer pipes meet the surface of the gel in the petri dish 6. This position is shown in FIG. 5B. Any further downwards movement of the plate 34 causes the transfer pipes to slide in the apertures provided for them in the plate 34, thus lifting the flanges 32 above the plate 34. Upwards return movement of the plate 34 causes the flanges 32 to re-engage the plate 34 so that the transfer tubes 31 are lifted back to the position shown in FIG. 5A.

A circular flat transfer plate 51, made of plastic material, is rotatably mounted against the undersurface of the bottom member 26. The plate 51 is made in two parts: a central part 52 which bears against the member 26; an outer annular part 53 carrying apertures and ridges, to be referred to later. The transfer plate 51 is biased to its extreme anticlockwise position (when viewed from above) by means of a spring (not shown). The central part 52 is equipped with an outwardly extending rim 57 which protrudes slightly into the bores 27. The rim 57 is arranged so as not to affect the dispensing operation, but to protrude sufficiently to act as a stop in order to define the vertical position of the cartridges. The cartridges are thus inserted into the respective bores 27 and are pressed down until the lugs 25 bear against the rim 57. The lid 16 is then closed, whereupon the resilient ring 29 bears against the top of the cartridges and retains them firmly in position.

Rotational movement of the transfer plate 51 is effected by means of a lever 54 having an enlarged end 55, which lever is attached to the transfer plate and extends through an elongated recess (not shown) in the bottom member 26. When the magazine unit is swung into position about the post 12, the lever 54 and peg 58 enter a cut-out 56 in the housing 1 and engage a locking lever assembly, described in detail hereinafter.

The upper surface of the part 53 of the transfer plate 51 is shaped as shown in the enlarged views of FIGS. 6, 7 and 8. The plate is equipped with eight equally spaced apertures 60 arranged in a circle coaxial with the plate itself. These apertures are such that they are approximately the same size as the discs to be dispensed, but sufficiently large to enable the disc to pass easily therethrough. In the normal, fully clockwise, position of the plate 51, each of the apertures 60 is in register with a respective aperture 27 in the bottom member 26. The plate 51 moves between this position and one in which each aperture 60 is in register with a respective aperture 30—this latter position is shown in FIG. 7. The total rotary movement of plate 51 is the pitch between adjacent apertures 27 and 30.

In between each aperture 60 is formed, on the upper surface of plate 51, an upstanding ridge 61. There are thus eight of these upstanding ridges, all identical in shape to that shown in FIG. 6. The top surface of each ridge 61 comprises a flat portion 62, parallel to the upper surface of the plate, followed by an upstanding shoulder 63 and a sloping portion 64. The upstanding ridges 61 move within the confines of a circular slot 65 cut in the under surface of the bottom member 26.

Particular reference will now be made to FIGS. 9 and 10 which show how the mechanical and hydraulic requirements of the magazine unit 11 are met.

When the magazine unit is swung into position, the orifice 44 in the protrusion 43 comes into contact with an orifice 70 on a cam follower block 71. By this means vacuum is applied, via the orifices 44 and 70 to the transfer pipes 31 in the magazine unit. The manner in which this is achieved is described in more detail in relation to FIG. 11.

Vertical movement of the support plate 34 and rotational movement of the transfer plate 51 are effected by cams 72 and 73 respectively, both mounted for simultaneous rotation on a shaft 74. The shaft 74 is rotated by an electric motor via drive belts (both not shown).

The cam 72 acts on a cam follower 75 rotatably mounted on the cam follower block 71. The block 71 is mounted for vertical movement only on three vertical shafts 76, mounted rigidly on the housing 1. A pair of vertical coil springs 77, positioned in respective bores machined in the block 71 act to bias the block 71 in a downwards direction, thus biasing the cam follower 75 against the cam 72.

When the magazine unit is swung into position, the protrusion 41 extends into a corresponding slit 78 in the cam follower block 71. As the cam 72 rotates, the cam follower block 71, and hence the support plate 34 in the magazine unit moves vertically and, provided the cam profile is correct, the sequence of movement described previously will be executed.

The motion of the cam 73 is transferred to the lever 54 in the magazine unit 11 via the agency of a locking lever assembly 79. The assembly 79 comprises a pair of parallel metal rods 80 and 81, of which rod 81 protrudes through an elongate cut-out 82 in the housing 1. Three link members 83, 84 and 85 are attached to the rods 80, 81 and fixedly link the rods together in the manner of the sleepers of a railway track. The link member 83 is freely mounted for rotation about the shaft 74 and the whole assembly 79 is biased in an anticlockwise direc- 10
14
22
14
24
12
20
18

110
86
70
66
98
68
88
74
96
108
72
74
14
90
72
78
80
82
84
90

16
46
32
30
60
32
26
16b
70
98
66
110
86
16a
68
3
36
38
12
76
40
30
108
3
78
90
88
84
80

108
14
68
32
26
34
80
114
48
108
106
84
112
50
108
28
106
114
88
68
108
32
34

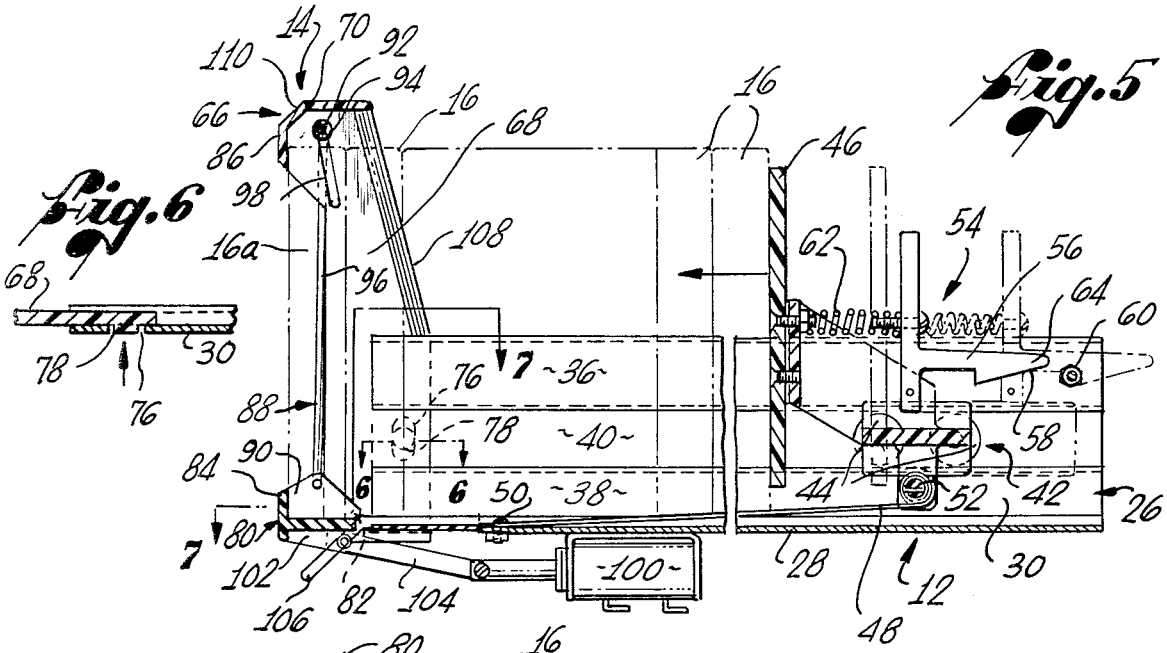
Fig.5
Fig.6
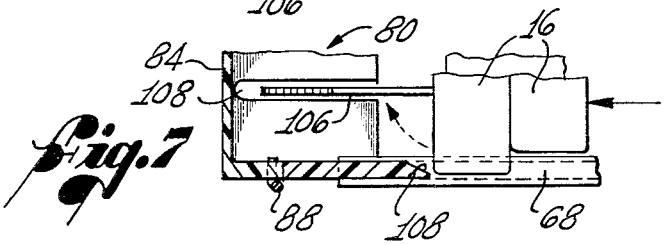
Fig.7
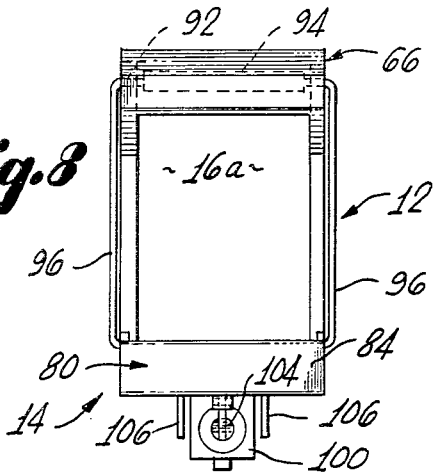
Fig.8
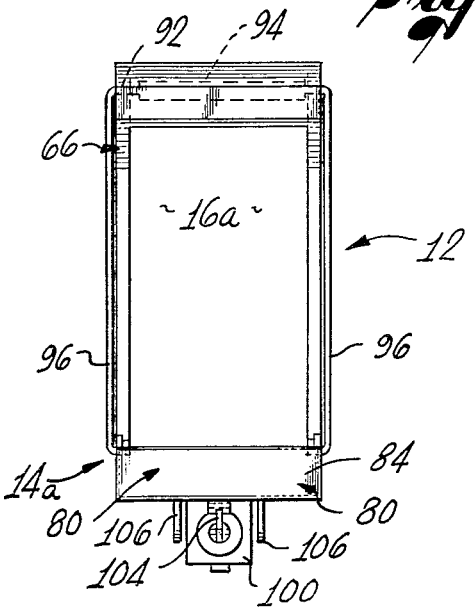
Fig.9
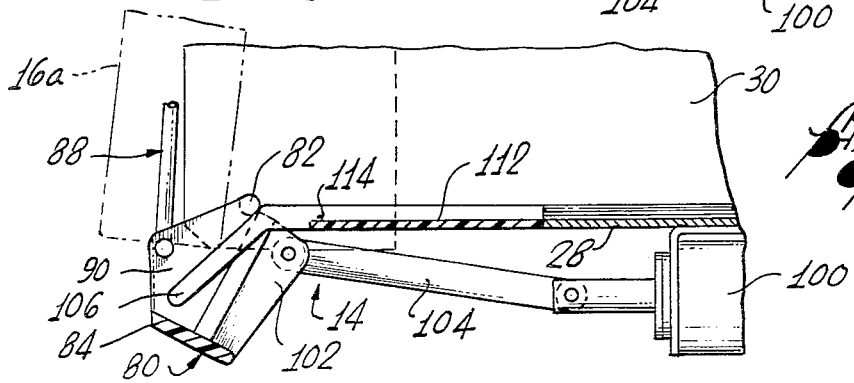
Fig.10

VENDING MACHINE OR THE LIKE WITH IMPROVED TRAP DOOR TYPE DISPENSING MECHANISM

CROSS-REFERENCE TO RELATED APPLICATIONS

The present invention is a continuation-in-part of application Ser. No. 914,560, filed on June 8, 1978 and entitled MACHINE FOR DISPENSING ARTICLES and application Ser. No. 762,113, filed on Jan. 24, 1977 and entitled ARTICLE DISPENSING MACHINE now U.S. Pat. No. 4,134,520.

BACKGROUND OF THE INVENTION

The present invention relates to vending machines and the like, and more, particularly, to a dispensing mechanism by which articles can be released from a module of a vending machine.

There is a wide variety of presently known vending machines with provisions for releasing products from the modules in which they are stored. The demands made on these dispensing mechanisms are high since they must be capable of a great many operating cycles without fail. Since the machines are at scattered locations, the need for service and repair must be minimized and the down time that results from a malfunction must be avoided. Moreover, these mechanisms, which often receive rough treatment from users, must be capable of operating reliably over a wide range of temperatures encountered at locations that are neither heated nor air conditioned. Humidity can present a further problem and articles such as cigarette packages tend to adhere to one another, particularly if the machine has not been operated for some time. Experience has shown that a machine is more likely to be subjected to vandalism if it malfunctions.

While some known dispensing mechanisms have been able to meet the reliability standards required of them, this may necessitate considerable expense and complexity, particularly when the size of the machine must be minimized and the contents of the machine must be well protected from theft.

A problem associated with a number of presently known dispensing mechanisms is that they are very limited with respect to the dimensions of the article they can dispense. In the vending of cigarettes, this problem is particularly acute since a wide variety of package dimensions are now in common use.

Most dispensing mechanism in use today are so interrelated to the surrounding structure of the machine that they must be repaired on site or else the entire machine must be transported to a repair facility. In addition, the dispensing mechanism associated with different modules, e.g., the various columns of cigarettes in a cigarette-vending machine, are interconnected to each other in such a manner that an individual dispensing mechanism cannot readily be serviced separately and a malfunction of one mechanism may effect many other mechanisms in the same machine.

The objectives of the present invention include the provision of a dispensing mechanism that is simple, reliable, jam-free, easily serviced and can easily be replaced to accommodate in the machine articles of different dimensions.

SUMMARY OF THE INVENTION

A vending machine constructed in accordance with one aspect of the present invention includes one or more modules in which articles to be vended are stored and a provision for moving these articles toward the front of the module where they are received by a dispensing mechanism. A pivotable trap door that forms part of the dispensing mechanism is movable between a retaining position in which it forms an extension of the module and supports the lead article and an inclined releasing position in which it allows the article to escape from the module. A hinge connects the trap door to the module along its trailing edge. At least one finger that presents an inclined guide surface extends downwardly from the module floor and is so positioned that it is located beneath the trap door in the retaining position but is located above the trap door in the releasing position. A slot in the door extends forwardly from its trailing edge and is so disposed that the finger passes through the slot as the door moves.

Preferably, there are two such fingers with a slot for each, the fingers being rigid and presenting downwardly inclined linear guide surfaces to the articles. A lip on the leading edge of the door retains the lead article prior to its release but drops down beneath the fingers when the door assumes its releasing position. An ejector bail can be connected to the trap door and extends above the lead article so that the movement of the door to its releasing position pulls the rod downwardly to eject the lead article by holding the next successive article against release.

According to another aspect of the invention, the dispensing mechanism includes a box-like frame in which the articles are received, the frame having vertical sides with forwardly inclined inwardly beveled edges for straightening articles as they enter the mechanism. A downwardly inclined cowl can be included in the frame, extending between its sides, to deflect falling articles dispensed from modules above.

According to still another aspect of the invention, the dispensing mechanism frame is secured to the module by detent mechanism releasable by bending the frame sides inwardly. An additional unique feature resides in the provision of a transparent window in the the module floor which permits the bottoms of articles to be viewed without removing the articles from the machine. This feature is of particular importance in connection with the vending of cigarette packages which contain tax stamps that must be visible for inspection purposes. The guide fingers of the dispensing mechanism can be integrally formed with the transparent window as a single molded plastic piece.

Other features and advantages of the present invention will become apparent from the following detailed description, taken in conjunction with the accompanying drawings which illustrate, by way of example, the principles of the invention.

BRIEF DESCRIPTION OF THE DRAWINGS

FIG. 5 is an enlarged, partially broken away cross-sectional view taken vertically through the module;

FIG. 6 is a further enlarged, fragmentary cross-sectional view of the detent mechanism by which the dispensing mechanism is secured to the module, taken along the line 6—6 of FIG. 5;

FIG. 7 is a further enlarged fragmentary cross-sectional view taken through the dispensing mechanism and front end of the module along the line 7—7 of FIG. 6;

FIGS. 8 and 9 are enlarged front end views of interchangeable dispensing mechanisms of different heights; and FIG. 10 is a further enlarged vertical cross-section of the lower front end of a module, including a dispensing mechanism, showing the lead article in a partially dispensed position.

DESCRIPTION OF THE PREFERRED EMBODIMENT

Figure 1:
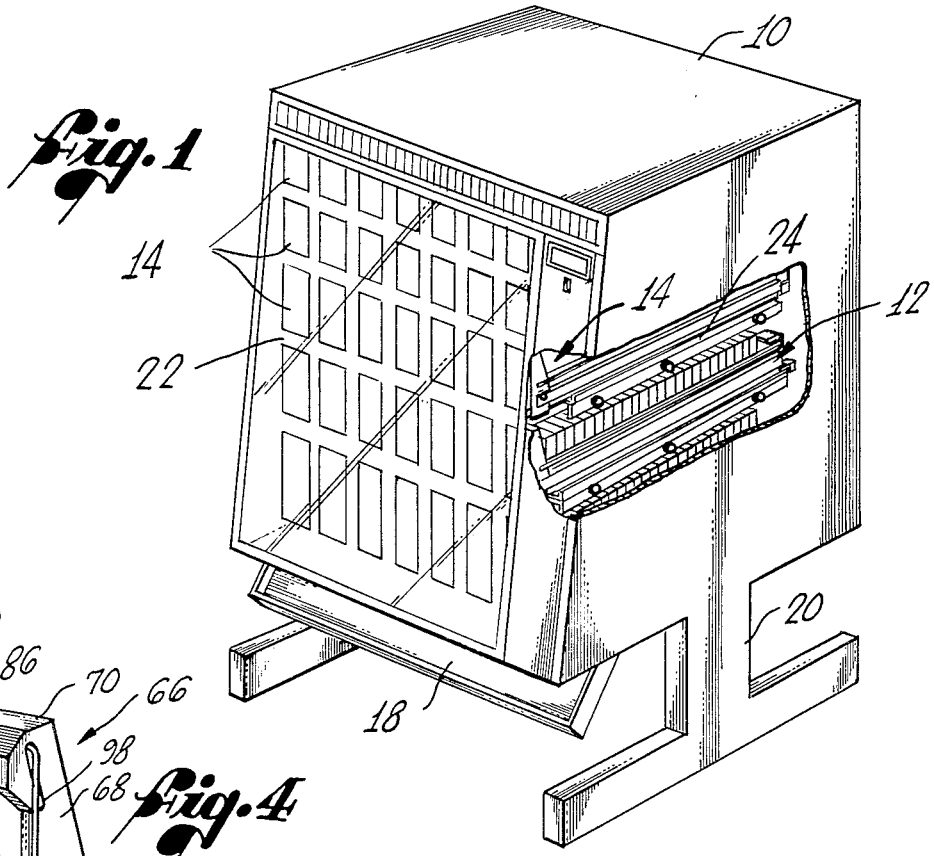
FIG. 1 is a perspective view of a vending machine constructed in accordance with the present invention, a portion of one side of the machine being broken away to expose its internal structure.

Shown in the drawings for purposes of illustration is a dispensing machine in which a cabinet 10 houses a plurality of horizontal rows of modules 12. Each module 12 extends horizontally from the front to the back of the cabinet 10, as shown in FIG. 1, and has a dispensing mechanism 14 (FIGS. 2, 4, 5, 8 and 9) at its front end by which successive articles 16 are released to fall into a tray 18 along the bottom, front edge of the cabinet 10. In this exemplary vending machine, the articles 16 to be dispensed are cigarette packages arranged one behind the other in the modules 12.

The cabinet 10 itself is a metal box-like structure that stands on two legs 20 and has an openable transparent front door 22. The modules 12 are supported within the cabinet 10 on drawers 24, each drawer supporting one horizontal row.

Each module 12 includes a trough-like, roll-formed metal structure 26 having a horizontal bottom 28 and vertical sidewalls 30 that have narrow outwardly bent flanges 32 along their top edges. Since the trough 25 is open-topped, it can be conveniently loaded from above when the drawer on which it is supported is pulled out. The bottom 28 is bent to form two parallel tracks 34 of inverted V-shaped cross-section that extend from front to back. The sidewalls 30, when viewed from inside the module (as in FIG. 5), form upper and lower lands 36 and 38 of approximately equal dimensions and separated by a horizontal groove or channel 40, as best shown in FIG. 5.

A carriage 42 positioned within the module 12 has two guide rollers 44 on either side which ride in a groove 40 (FIG. 5), permitting the carriage to move between the front and back ends of the module. A vertical pusher plate 46 carried by the front of the carriage 42 engages the back surface of the rearmost article 14 to urge it toward the dispensing mechanism 14 at the front of the module 12 as the carriage 42 is advanced. Urging the carriage 42 toward the front end is a tape spring 48, one end of which is secured by a fastener 50 (FIGS. 3 and 5) to the floor 28 of the module 12 near its front end, the other end of the spring being secured to a non-rotatable, horizontal pin 52 carried by the carriage 42 and extending transversely across the module (FIG. 5). When unwound, the spring 48 extends along the floor 28 of the module 12 between the tracks 34 and, since it has a resilient tendency to coil around the pin 52, it urges the carriage 42 toward the dispensing mechanism 14. It is a characteristic of this type of spring 48 that the driving force exerted on the carriage 42 remains substantially constant regardless of the position of the carriage within the module 12 and the extent to which the spring is unwound.

The carriage 42 includes a latching mechanism 54 by which it which can be retained at the rear of the module 12 while additional articles 16 are being inserted in front of the pusher plate 46 (FIG. 5). This latching mechanism 54 includes a rearwardly extending pivotably mounted arm 56. As the carriage 42 approaches the rear of the module 12, a downwardly facing inclined camming surface 58 on the back end of the arm 56 rides over a rod 60 that extends across the module 12 between the sidewalls 30, causing the end of the arm to be lifted against the bias of a spring 62 and allowing a downwardly facing hook 64 carried by the arm to engage the rod and retain the carriage (as shown in phantom lines in FIG. 5).

Figure 4:
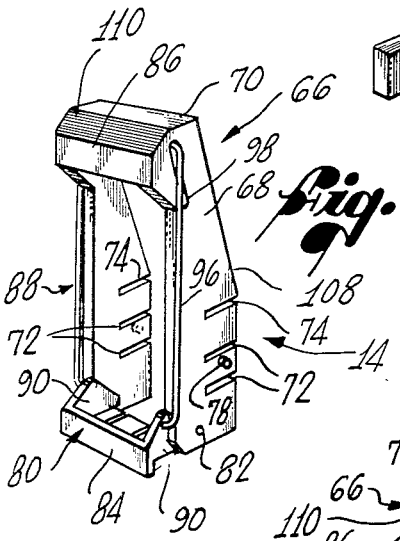
FIG. 4 is an enlarged perspective view of the dispensing mechanism alone.
Figure 2:
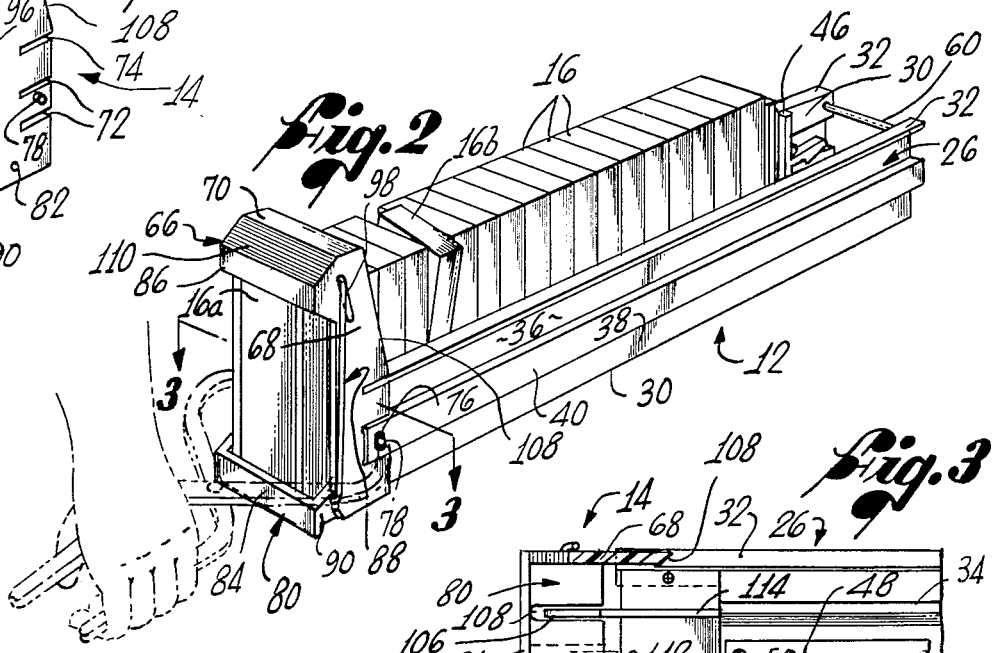
FIG. 2 is an enlarged perspective view of a single article containing module of the machine with its associated dispensing mechanism, also illustrating the use of a tool by which the dispensing mechanism can be detached.

At the front end of the module 12 is the dispensing mechanism 14 which includes a box-like frame 66 having vertical sides 68 connected by a flat horizontal top 70 (as best shown in FIG. 4). Each side 68 is provided with two forwardly extending short horizontal slots 72 by which it interlocks with the front end of a trough-like module structure 26 so that the land-forming portions 36 and 38 of the module engage the inner surfaces of the sides 68 whereas the groove-forming portion 40 of the module engages the outer surfaces. An upper third slot 74 receives the outwardly extending stiffening flange 32. An aperture 76 is formed in each groove 40 near its front end to receive an outwardly facing lug 78 (FIG. 4) on the corresponding side 68 of the dispensing mechanism 14, the aperture and the lug together forming a detent mechanism which secures the dispensing mechansim to the trough-like structure 26 (FIGS. 2 and 5). To remove the dispensing mechanism 14 from the module 12, it is merely necessary to press inwardly on the two lugs 78 simultaneously, (as illustrated in phantom lines in FIG. 2), causing the sides 68 to bend inwardly until the lugs 78 are disengaged from the apertures 76.

The dispensing mechanism 14 includes a retaining member in the form of a trap door 80 which extends across the front of the module 12, and is pivotably connected to the end of the module floor 28 by a hinge pin 82 (as best shown in FIGS. 5 and 10). It is movable between a retaining position (FIG. 5) in which it forms a horizontal extension of the floor 28 and a releasing position (FIG. 10) in which it is inclined sharply downwardly from the module 12. An upstanding lip 84 extends across the leading edge of the trap door 80.

The lead article **16*a* in the module 12 is received by the frame 66 of the dispensing mechanism 14, being urged forwardly by the carriage 42 but restrained at the top by a fixed front panel 86 that connects the frame side 68 and at the bottom by the lip 84. The article 16*a* cannot escape from the dispensing mechanism 14 unless the trap door 80** pivots downwardly from its retaining position to its releasing position.

To provide for positive ejection of the leading article **16*a* when the dispensing mechanism 14 is operated, an inverted U-shaped ejector bail 88 is privotably connected to the side pieces 90 that extend upwardly on either side of the trap door 80 so that the top 92 of the bail extends horizontally across the top of the lead article 16***a*. A roller 94 is rotated on the horizontal top portion 92 of the bail 88 to minimize friction upon engagement with the lead article 16*a*. Vertical side portions 96 of the bail 88 extend along the outside of the dispensing mechanism sides 68 and are connected to its top 92 portion through slots 98 in the sides, the slots being long enough to permit the desired downward movement of the roller 94. Each slot 98 extends forwardly and upwardly, forming an angle of about 8 to 12 degrees with the vertical, preferably about 10 degrees.

When the trap door 80 pivots into its releasing position, the effect is to pull the roller 94 down against the lead article 16*a* pulling the article downwardly far enough to pass under the front panel 86 of the frame 66 and permitting the article to escape (FIG. 10). The ejector bail 88 is important because the force of gravity may not be sufficient to cause the lead article 16*a* to overcome the frictional forces that would resist its downward movement. Moreover, the packages 16 in the module 12 may tend to stick together and the force of the roller 94 may be necessary to ensure repeatable and consistent jam-free action. Movement of the trap door 80 and bail rod 88 is produced by the action of a solenoid 100 mounted on the underside of the module floor 28 and detachably connected to an ear 102 on the underside of the door by a link 104 (FIGS. 5 and 10).

The precise point of engagement of the roller 94 with the article 16*a* and the direction in which the roller moves are important if a smooth, jam-free action is to be obtained and if double vending is to be avoided. These parameters are controlled primarily by the placement and orientation of the slots 98. The roller 94 should contact the article 16*a* rearwardly of its transverse centerline (as best shown in FIG. 6) and should continue to move rearwardly as it moves downwardly. This motion separates the lead article 16*a* from the one behind it and causes the bottom end of the lead article to tilt outwardly.

Figure 3:
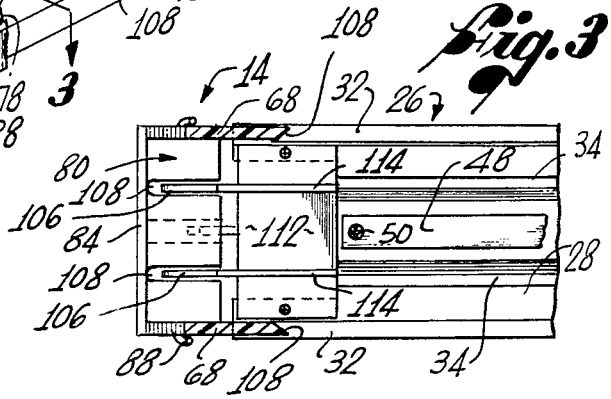
FIG. 3 is a further enlarged, fragmentary cross-sectional view of the front end of the module taken along the line 3—3 of FIG. 2.

As the lead article 16*a* moves out of the dispensing mechanism 14, it should be guided over the top edge of the lip 84 and at the same time urged outwardly away from the front end of the module 12. This is the function of two stationary, rigid guide fingers 106 that are inclined downwardly from the leading edge of the floor 28, preferably at an angle of approximately 45 degrees. The fingers 106 are equally spaced on opposite sides of the centerline of the module 12, as best shown in FIG. 3. There are two elongated narrow slots 108 in the trap door 80 which extend forwardly from its trailing edge and are aligned with the fingers 106. Thus, the fingers 106 pass through the slots 108 as the trap door 80 moves from its retaining to its releasing position (FIGS. 7 and 10). It should be noted that the trap door 80, when in its releasing position, is inclined downwardly at a steeper angle than the fingers 106 so that the outer ends of the fingers are located above the top edge of the lip 84. The fingers 106 are of sufficient length to closely approach the lip 84 when the trap door 80 is in its releasing position, thereby ensuring that the lead article 16*a* cannot become entrapped as it slides downwardly on the linear guide surfaces on the tops of the fingers.

It must be remembered that in a vending machine context, the dispensing mechanisms 14 must operate reliably over many cycles while subject to variations in the precise dimensions, hardness and surface of articles 16 to be dispensed. It has been found that the provision of guide fingers 106, as described above, is of considerable importance in ensuring this reliability.

One of the important features of the machine is that it operates reliably regardless of mis-alignment of articles 16 in the modules 12 since the frame 66 of the dispensing mechanism 14 forces the articles 16 to assume an approximately upright position in which the lead article 16*a*, and only that article, will be dispensed smoothly upon actuation of the solenoid 100. If one article 16*b* is badly askew, as illustrated in FIG. 2, the trailing edges 108 of the frame sides 68 will at least partially straighten it so that it can properly enter the dispensing mechanism 14. To accomplish this straightening effect, the trailing edge 108 of the side which extends above the trough-like structure 26 is inclined forwardly toward the top 70 (as shown in FIGS. 2, 4 and 5) and is beveled inwardly (as shown in FIGS. 3 and 7). This configuration of the sides 68 prevents jamming of the machine due to improper loading of the modules 12.

To further ensure that a descending article 16 will be properly guided toward the tray 18 at the bottom of the machine, the leading top portion of each dispensing mechansim frame 66 forms a cowl in which an inclined surface 110 extends downwardly from the top 70 to the front panel 86. Thus, if a dispensed article 16 should strike one of the dispensing mechanisms 14 disposed beneath that from which it is ejected, it will be deflected outwardly and toward the door 22 by this inclined surface 110.

When the machine is used to vend cigarette packages, it is generally required that inspectors be able to view tax stamps on the bottom of one to three or more articles 16 at the front of each module 12. This is accomplished, in accordance with the present invention, by including a transparent plastic window 112 that forms the forward part of the module floor 28, as best shown in FIGS. 3 and 10. Since this window 112 is located forwardly of the fastener 50 by which the spring 48 is attached, the spring 48 need not extend forwardly far enough to interfere with the visibility of the stamps. The fingers 106 are integrally formed with the window 112 as part of a single molded plastic piece for simplicity of construction and assembly and molded extensions 114 of the tracks 34 are included in the window. The trap door 80 is also made of transparent plastic so that the tax stamp of the lead article 16*a* can be observed.

It should be noted that cigarette packages, by way of example, come in a variety of heights and not all such packages can be reliably dispensed from a single dispensing mechanism 14. It is desirable to enable the operator of the machine to vary the position within the machine of the dispensing mechanisms 14 of any particular height and to vary the number of dispensing mechanisms of that height so that the machine can present the optimum array of products visible through the transparent front door 22. This optimum array is determined by the purchasing patterns that prevail at a particular location. Moreover, it should be possible to accommodae new sizes of packages that may become available in the future and to mix in a single machine different articles 16, such as cigarettes and cigars, that may require dispensing mechanisms of different heights. The present invention easily accommodates this requirement since it allows an unskilled operator to quickly and easily remove one dispensing mechanism 14, such as that shown in FIG. 8 and suitable for "regular" cigarettes, and replace it with a taller mechanism 14*a*, such as that shown in FIG. 9 and suitable for longer 120 millimeter cigarettes.

It will be appreciated from the foregoing that the present invention provides a relatively trouble-free and jam-free vending machine that is conveniently loaded and easily serviced in the field by unskilled personnel. In addition, it provides an attractive display of the articles 16 to be vended since the dispensing mechanisms 14 have open front ends and can provide a full view of the product in its upright position. In addition, it is readily adaptable to dispense articles 16 of varying sizes.

While a particular form of the invention has been illustrated and described, it will be apparent that modifications can be made without departing from the spirit and scope of the invention.

We claim:

1. In a vending machine having at least one module in which articles to be vended are stored and means for moving said articles toward a front end of said module, a dispensing mechanism disposed at said front end to receive a lead one of said articles to be vended, said dispensing mechanism comprising:

a trap door movable between a retaining position forming an extension of said module in which said article is supported thereby and a downwardly inclined releasing position in which said article is released;

a hinge by which said trap door is pivotably connected to said module along a trailing edge thereof for movement between said retaining and releasing positions; and at least one finger having an inclined guide surface that extends downwardly from said module and is disposed so that said guide surface is located beneath said trap door when said trap door is in said retaining position and is located above said trap door when said trap door is in said releasing position;

said trap door having a slot therein extending forwardly from said trailing edge and disposed so that said finger passes through said slot as said trap door moves between said retaining and releasing positions.

2. The apparatus of claim 1 wherein said finger is rigid.

3. The apparatus of claim 1 wherein said finger is rigid and integrally formed with a portion of said module.

4. The apparatus of claim 1 wherein there are at least two of said fingers, both of which are rigid, and said guide surfaces are linear.

5. The apparatus of claim 1 further comprising bail means for urging said lead article downwardly as said trap door moves from said retaining position to said releasing position.

6. The apparatus of claim 5 wherein said bail means comprises a bail rod that extends over the top of said lead article and is connected to said trap door for downward movement therewith.

7. The apparatus of claim 6 wherein said bail means further comprises a roller rotatable on said rod and engageable with said lead article.

8. The apparatus of claim 6 further comprising means for causing said ball rod to contact said lead article rearwardly of its transverse centerline and for guiding the motion of said bail rod downwardly and rearwardly with respect to the vertical.

9. The apparatus of claim 8 wherein said downward and rearward movement of said ball rod forms an angle of about 8 to 12 degrees with the vertical.

10. The apparatus of claim 1 wherein:

said module has a floor including a transparent plastic portion forming a window through which the bottom surfaces of at least one of said articles can be viewed; and said finger is rigid, plastic and integrally formed with said plastic floor portion.

11. The apparatus of claim 1 in which said trap door includes an upstanding lip on a leading edge thereof opposite said trailing edge, said finger being so positioned that it includes a guide surface disposed above said lip when said trap door assumes its releasing position.

12. In a vending machine having at least one module in which articles to be vended are stored and means for moving said articles toward a front end of said module, a dispensing mechanism disposed at said front end to receive a lead one of said articles to be vended, said dispensing mechanism comprising:

a trap door movable between a retaining position forming an extension of said module in which said article is supported thereby and a downwardly inclined releasing position in which said article is released;

a hinge by which said trap door is pivotably connected to said module along a trailing edge thereof for movement between said retaining and releasing positions;

at least one finger having an inclined guide surface that extends downwardly from said module and is disposed so that said guide surface is located beneath said trap door when said trap door is in said retaining position and is located above said trap door when said trap door is in said releasing position; and bail means for engaging said lead article rearwardly of its transverse centerline as said trap door moves from said retaining position to said releasing position and for urging said lead article rearwardly and downwardly.

13. The apparatus of claim 12 wherein aid bail means urges said lead article at an angle of about 8 to 12 degrees with respect to the vertical, thereby causing the bottom end of said lead article to move outwardly away from said dispensing mechanism.

14. A vending machine comprising:

an open top, through-like module in which articles to be vended are stored;

means for pushing said articles toward a front end of said module; and a dispensing means at said front end of said module for dispensing said articles thereform, said dispensing means including a box-like frame rising above said module and arranged to receive said articles, said frame having forwardly inclined inwardly beveled edges for straightening said articles as they enter said dispensing mechanism.

15. The vending machine of claim 14 wherein said dispensing means includes a trap door positioned forwardly of said edges and forming part of said frame, said trap door being movable between a retaining position forming an extension of said module in which said articles are supported thereby and a downwardly inclined releasing position in which said articles are selectively released.

16. The apparatus of claim 14 wherein said frame includes a downwardly inclined cowl extending between said sides to deflect falling articles.

17. The apparatus of claim 14 further comprising detent means at least a portion of which is carried by said sides by which said frame is secured, said sides being bendable to release said detent means so that said frame can be removed.

18. The vending machine of claim 15 further comprising a hinge by which said trap door is pivotably connected to said module along a trailing edge thereof for movement between said retaining and releasing positions.

19. The vending machine of claim 18 further comprising at least one finger having an inclined guide surface that extends downwardly from said module and is disposed so that said guide surface is located beneath said trap door when said trap door is in said retaining position and is located above said trap door when said trap door is in said releasing position.

20. The vending machine of claim 19 further comprising bail means within said frame for engaging said lead article as said trap door moves toward said releasing position.

21. A dispensing machine comprising:

a plurality of modules for storing articles to be dispensed;

a plurality of dispensing means each associated with one of said modules for dispensing articles therefrom, said dispensing means each including a frame having sides and a top in which said articles are received, a trap door forming part of said frame, hinge means for pivotably connecting said trap door to an associated one of said modules along a trailing edge of said trap door, a pair of fingers extending forwardly and downwardly from said module, and a pair of slots in said trap door extending forwardly from said trailing edge to permit said fingers to pass therethrough;

said dispensing means being divided into groups having sides of various heights to receive articles of different sizes; and detent means by which said dispensing means are releasably secured to said modules, whereby said dispensing means are rendered interchangeable.

22. In a vending machine having at least one module in which articles to be vended are stored and means for moving said articles toward a front end of said module, the improvement comprising:

a box-like frame arranged to receive said articles, said frame having vertical sides with forwardly inclined, inwardly beveled edges for straightening said articles as they enter said dispensing mechanism;

a trap door forming part of said frame;

hinge means for pivotally connecting said trap door to said module;

a pair of elongated slots in said trap door extending forwardly from said trailing edge to permit said fingers to pass therethrough; and means for causing said trap door to pivot to dispense one of said articles.

23. The apparatus of claim 22 wherein said module has a floor including a transparent plastic window portion through which the bottom surfaces of at least one of said articles can be observed, said fingers being plastic and integrally formed with said window portion.

24. In a vending machine, the apparatus comprising:

a horizontal trough-like structure having sidewalls and a floor and adapted to contain a row of articles to be dispensed, each of said sidewalls having an outwardly projecting groove portion that forms a track;

carriage means for moving said articles along said trough-like structures, said carriage means engaging said tracks to be guided thereby;

dispensing means at one end of said trough-like structure for receiving and releasing said articles, said dispensing means including a frame having sides that interlock with said projecting portions of said sidewalls; and detent means for releasably securing said frame sides to said sidewalls.

25. The apparatus of claim 24 wherein said detent means comprises an aperture in each of said projecting portions and an outwardly facing lug on each of said sides received by one of said apertures, said sides being inwardly bendable to permit said lugs to be disengaged from said apertures.

26. The apparatus of claim 24 wherein said sides have forwardly inclined, inwardly beveled edges for straightening said articles as they enter said dispensing means.

27. The apparatus of claim 24 wherein said dispensing means further comprises a downwardly inclined cowl extending between said frame sides to deflect falling articles.

28. A vending machine comprising:

at least one horizontal trough-like structure in which articles to be dispensed can be arranged in a row, said structure having a floor and sidewalls with tracks extending therealong;

carriage means engaging said tracks for advancing said articles along said trough-like structure toward a front end thereof;

dispensing means disposed at said front end of said trough-like structure comprising two vertical sides interlocked with said walls of said modules, each of said sidewalls having a forwardly inclined and inwardly beveled surface for straightening said articles as they advance, detent for releasably securing said sides to said sidewalls, a downwardly inclined cowl extending between said sides to deflect falling articles, a trap door pivotably supported along a trailing edge thereof to form an extension of said floor when in a retaining position and being downwardly movable to a releasing position, a pair of slots in said trap door extending forwardly from said trailing edge, a pair of rigid fingers secured to said floor and inclined downwardly therefrom, said fingers being aligned with said slots to pass through said slots as said trap door moves from said retaining position to said releasing position, and bail means extending above one of said articles and connected to said trap door for downward movement therewith to eject said one of said articles.

* * * * *